United States Patent [19]

Baer

[11] 4,400,138

[45] Aug. 23, 1983

[54] MULTIPLE JET EDUCTOR

[76] Inventor: William F. Baer, 1509 N. Darcy, Simi Valley, Calif. 93065

[21] Appl. No.: 312,522

[22] Filed: Oct. 19, 1981

[51] Int. Cl.[3] ..... F04F 5/46

[52] U.S. Cl. ..... 417/179; 417/181; 417/195; 417/197; 29/156.4 R; 29/450

[58] Field of Search ..... 417/178, 179, 180, 181, 417/195, 197; 29/156.4 R

[56] References Cited

U.S. PATENT DOCUMENTS

| | | | |
|---|---|---|---|
| 2,111,266 | 3/1938 | Hopkins | 417/179 |
| 2,786,651 | 3/1959 | Mickle | 417/179 |
| 3,175,515 | 3/1965 | Cheely | 417/197 |
| 3,217,400 | 11/1965 | Illesy et al. | 29/450 |
| 3,323,468 | 6/1967 | Thompson | 417/195 |
| 3,369,735 | 2/1968 | Hoffmeister | 417/195 |
| 3,396,994 | 8/1968 | Ito et al. | 29/450 |
| 3,448,691 | 6/1969 | Frazier | 417/197 |
| 3,457,863 | 7/1969 | Carter | 417/163 |
| 3,887,992 | 6/1975 | Parmann | 29/450 |

OTHER PUBLICATIONS

Matt Thornton: "Dredging for Gold," 3rd Printing, 1979, pp. 30–37.

*Primary Examiner*—William L. Freeh
*Assistant Examiner*—Paul F. Neils
*Attorney, Agent, or Firm*—Emmette R. Holman

[57] ABSTRACT

An improved multiple jet eductor assembly is described consisting of two parts:

(1) a manifold ring with a pressurized water inlet and a plurality, preferably four, of radially-spaced, forwardly- and convergingly-directed jet nozzles, and (2) a tube having a bell end, near the bell end at a fixed axial distance therefrom a number of peripheral bosses radially disposed, equal in number to the plurality of nozzles, each boss containing a forwardly- and convergingly- directed porthole adapted to snugly receive a corresponding one of the jet nozzles.

The eductor is assembled by forced simple coaxial translational motion of part 1 over the bell end of part 2, the nozzles engaging and entering the portholes with transitory snake-like flexure to reach a "home position" whereat the nozzles revert to their original, free of stress or distortion, molded, straight configuration, utilizing the unique memory property of viscoelastic materials, and securing part 1 to part 2 proximally in the "home position".

14 Claims, 14 Drawing Figures

1
2
3
4
5
10
11
12
13
14
15
22
23
25
26
28
29

MULTIPLE JET EDUCTOR

BACKGROUND OF THE INVENTION

This invention relates to the eductor used in hydraulic processing (dredging) of placer deposits for the recovery of values therein, usually gold. A good up-to-date description of gold dredging in all of its aspects including equipment, is to be found in Matt Thornton's book: "Dredging for Gold", first printing 1975. The suction gold dredge is described and illustrated on pages 31 to 35 in the 3rd printing (1979) version.

On p. 35, the beginning with par. 3 and continuing to the middle of p. 37, the author discusses the basic "power jet" or eductor as being widely used since the late '60's; however, in the past few years, some manufacturers have developed interesting variations on the original theme. Perhaps the most significant is known as a "four eductor", or "four banger" power jet. Instead of using a single orifice assembly welded onto the straight metal tube, the 4-eductor jet, as the name implies, has 4 orifices assemblies; these are spaced 90° apart on the outside surface of the metal tubing, all of them the same distance from the end of the tube where the suction hose is clamped on. All 4 orifice assemblies are fed by a single "water manifold", which is around, enclosed chamber encircling the straight metal tube, with openings into the 4 eductors. The pressure hose from the dredge's pump output is coupled to the water manifold. When the dredge engine is started and the manifold fills with water, 4 jet streams—all equal in velocity and pressure—shoot into the straight metal tube. The "quadradial" jetting arrangement serves to distribute the physical wear equally throughout all parts of the jet tube, resulting in longer "jet life".

The device of the present disclosure is an improvement on the device described above in the direct-quoted words of Thornton. In the Thornton device the four jet nozzles must be joined each at one end to the eductor tube and at the other end to the manifold ring by welding together the separate metal elements. The intricate assembly is a welder's nightmare. The finished eductor is a heavy, expensive, one-piece assembly with a relatively short service life in the wet, abrasive, corrosive environment of its use. The jets cannot be quickly interchanged with others of the same or different bore. Instead, the entire eductor assembly must be replaced.

The improved eductor of this invention consists essentially of two separate parts: (1) a manifold ring provided with a plurality, preferably four, of radially-spaced, forwardly- and convergingly- directed jet nozzles and, (2) a tube having a bell end, near the bell end at a fixed axial distance therefrom a number of peripheral bosses, radially disposed and equal in number to said plurality of nozzles. Each boss contains a forwardly- and convergingly- directed porthole adapted to snugly receive a corresponding one of the jet nozzles.

Each of the two parts of the eductor assembly is made of viscoelastic polymer, a material uniquely characterized by having a "memory" whereby it is capable of reverting in due time to its original shape, length or configuration after transitory bending or stretching.

The "memory" is utilized when the eductor is assembled by forcing the nozzle tips of the manifold ring over the bell end of the tube into registry with corresponding portholes. The nozzle tips in the original as cast configuration are exteriorly tangent to an inscribed circle of a diameter which is substantially less than the outside diameters of the bell end and of the inscribed circle of the portholes. Accordingly, the nozzle tips are forcibly bent divergingly to register with the portholes. As the nozzle tip enters the porthole the penetrated portion of the nozzle shank must thereafter bend convergingly, i.e., it must negotiate snake-like a divergent-convergent or S-curve flexure. As the penetration continues to advance by forced coaxial translational motion of the manifoild ring over the tube, a point is reached where the bending stresses vanish, the nozzles straighten out and revert to their original as cast configuration coaxially aligned within their corresponding portholes. For the purpose of this disclosure we designate this critical extent of penetration as the "home position."

The dimensions and the angle of convergence are carefully selected so that in the home position the tip of the nozzle is slightly outside of the inside diameter, or throat, of the tube. This allows about 0.125" for fine adjustment of the manifold ring by coaxial translational motion forward or reverse from the home position to optimize the suction performance of the eductor. It is not recommended, however, to advance the ring past the point where the nozzle tip enters the throat of the tube. This introduces a restriction in the throat where large size rock will be intercepted, causing blockage. Furthermore, the nozzle tips would be exposed to undesirable abrasion and wear.

The snake-like flexure mechanism of the nozzle described above is not actually the sole active deforming participant. It should be understood that other elements of the manifold ring and of the eductor tube cooperatively deform with the nozzles under the stress and revert to their original as cast configuration upon relief of the stress. For example, the conical base of each nozzle is joined to the forward face of the manifold ring which face it subjects to buckling deformation by leverage action of the force applied to the nozzle, while the nominally circular body of the manifold ring itself is pulled outwardly toward the corners of an n-polygon, where n designates the number in said plurality of jet nozzles. The stress on the eductor tube circular cross-section is equal and opposite to that on the manifold ring. When the circular tube is subjected to complementary inwardly-directed forces its circular shape tends to be dimpled into a rose of n-petals, but these distortions are imperceptibly small. The extent to which each of the elements contribute to the total viscoelastic deformation is not known. Let it suffice for the purpose of making this disclosure to attribute the distortion exclusively to the nozzle, i.e., the shank of the nozzle, and to consider all of the other elements to be rigidly unyielding and undeformed during the process of assembly and/or dissasembly. The term: "transitory snake-like flexure" hereinafter applied to the nozzle or the shank of the nozzle accordingly, is intended to embody the total aggregate viscoelastic distortion of all participating elements of the eductor.

It is an object of the invention to provide a two part multiple jet eductor which can be discussed and reassembled easily and quickly in the field, replacing either part as necessary with an interchangeable part.

It is another object to provide a multiple jet eductor having improved resistance to abrasion and wear for a longer useful life.

It is still another object to provide a multiple jet eductor constructed of non-rusting, corrosion resistant material.

It is still another object to provide a multiple jet eductor constructed of material having high lubricity and non-galling characteristics, with a natural resistance to dents and permanent deformation, which is resilient to the impact of ingested rocks, whereby oversize rocks wedged in the throat of the eductor are dislodged by momentary ovalization of the bore under the imposed wedging stress.

It is still another object to provide a multiple jet eductor which is about 75% lighter and more compact than present all metal welded eductors of the same nominal throat diameter and of more compact configuration thereby to reduce the effort and space needed to haul and backpack it into remote mountain streambed destinations.

It is still another object to provide a multiple jet eductor which is more maneuverable in fast water currents for an operator balancing with insecure footing on sharp or slippery submerged rocks.

It is still another object to provide a multiple jet eductor having latitude for fine adjustment of the position of the jet nozzle tip relative to its angle of convergence in the throat so as to maximize the performance in eduction.

It is still another object to provide a multiple jet eductor having a size-stepped water inlet adapted to receive pressure water hoses in a variety of sizes.

It is still another object to provide a multiple jet eductor which is provided with a water hose stub directed forwardly and/or one that is directed rearwardly for the optional attachment of a length of hose used for flushing away lighter sediments overlying the values, particularly in cavities and in interstices between large rocks.

It is still another object to provide a multiple jet eductor having thread lugs in the inside diameter of the bell end to threadably receive and secure one end of the spiral wound flexible suction hose.

These objects are successfully embodied in the herein disclosed device.

BRIEF DESCRIPTION OF THE DRAWINGS

In the drawings:

FIG. 14 is a view showing the nozzle advanced beyond the home position.

DETAILED DESCRIPTION

Figures 1, 2, 3, 4:
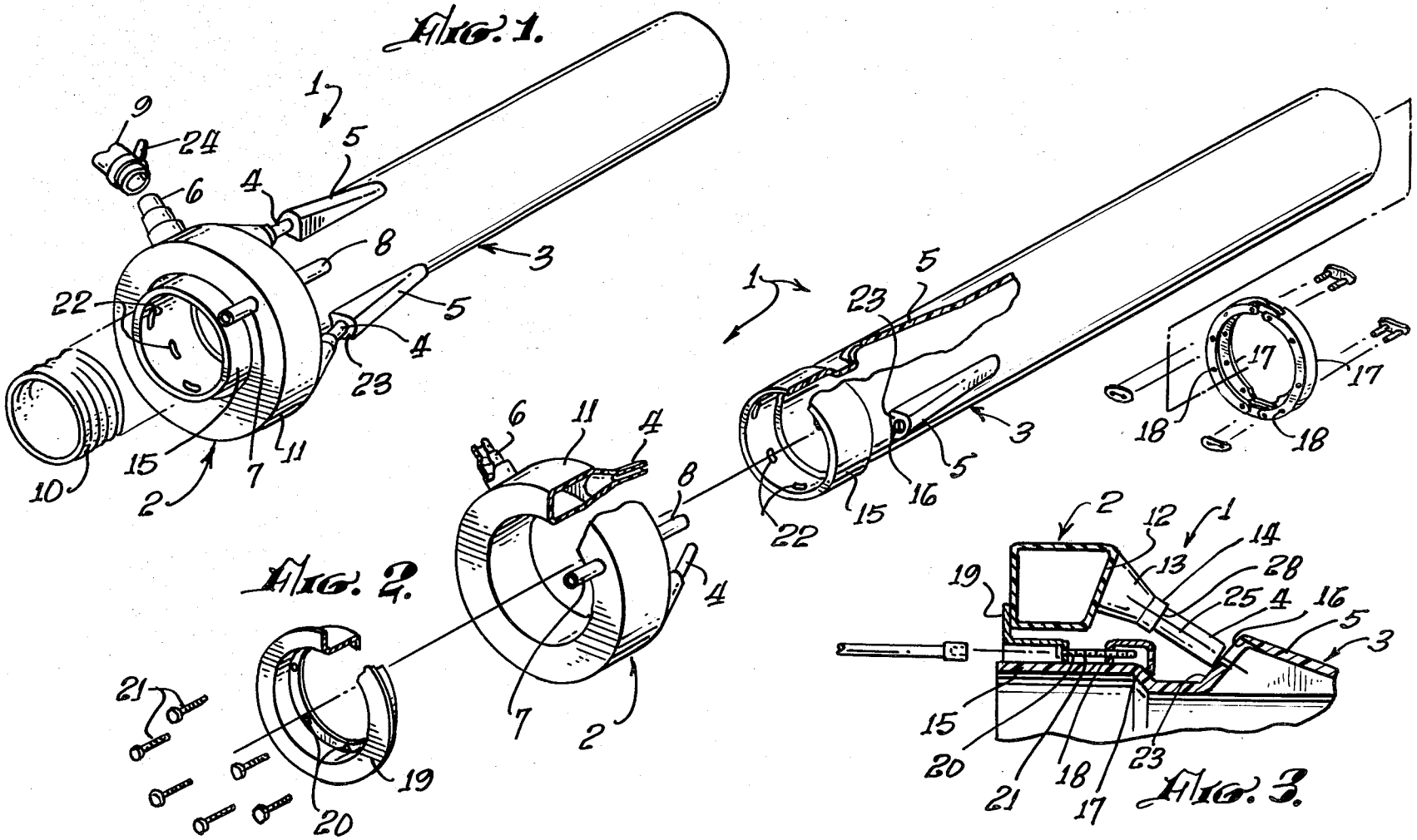
FIG. 1 is a perspective view of the assembled eductor with the hoses shown prior to attachment.
FIG. 2 is an exploded view of the apparatus of FIG. 1.
FIG. 3 is an enlarged fragmentary section of optional clamp tightening means for advancing the manifold ring assembly into registry with the porthole and further through penetration thereof to the home position and securing thereat.
FIG. 4 is an enlarged section through the device of FIG. 1.
Figures 4, 5:
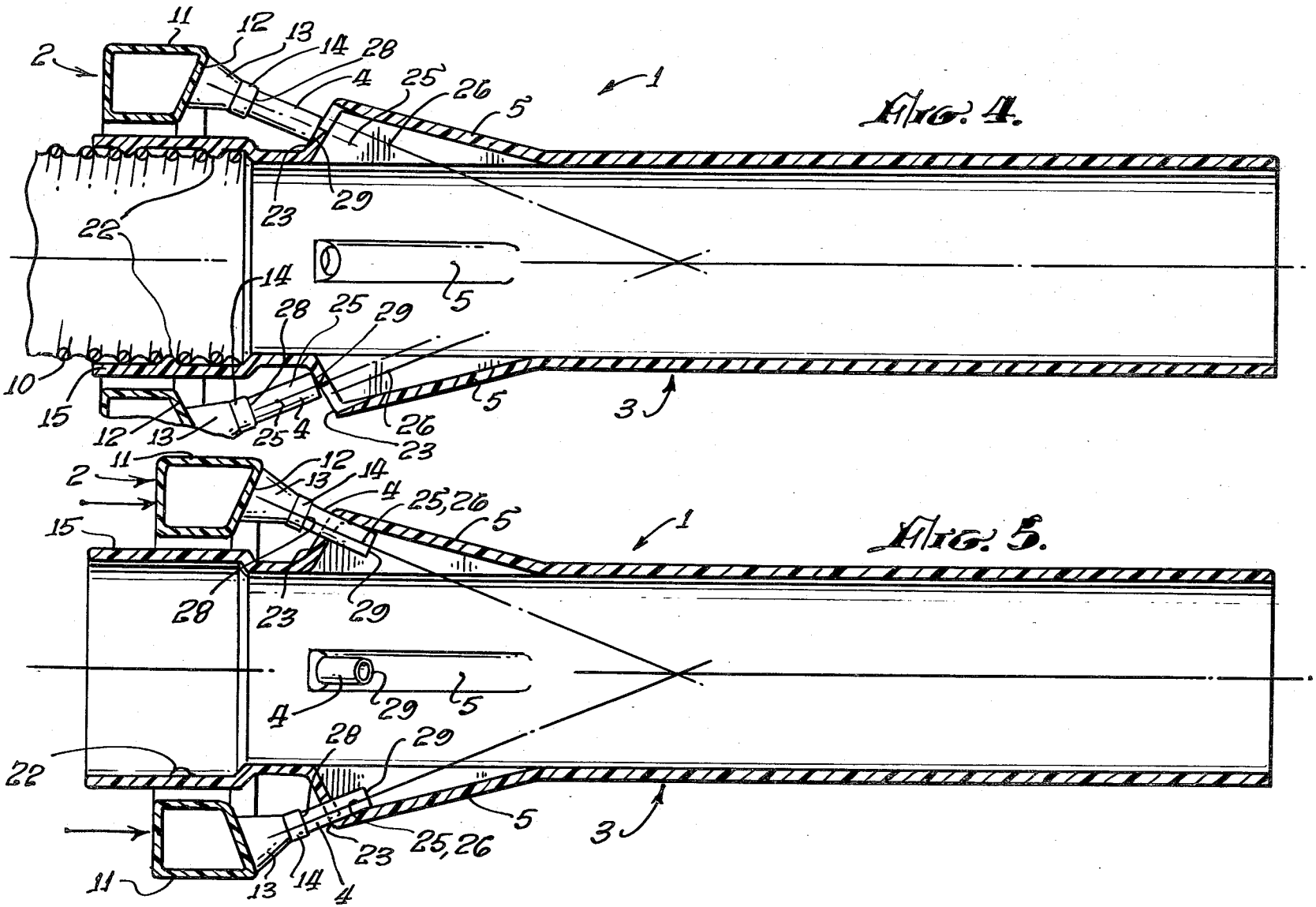
FIG. 5 is a view similar to FIG. 4, but with the manifold ring advanced to the home position.
Figure 6:
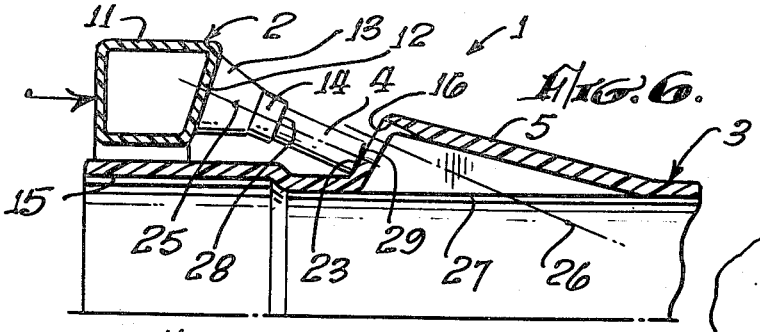
FIGS. 6 through 14 are fragmentary sections and fragmentary perspectives showing the procedural movement of the jet nozzles as they are advanced to the home position and beyond.
Figure 7:
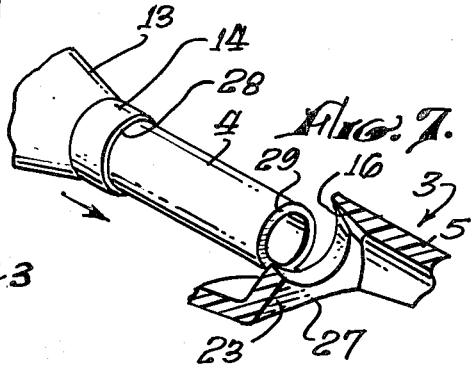
Figure 8:
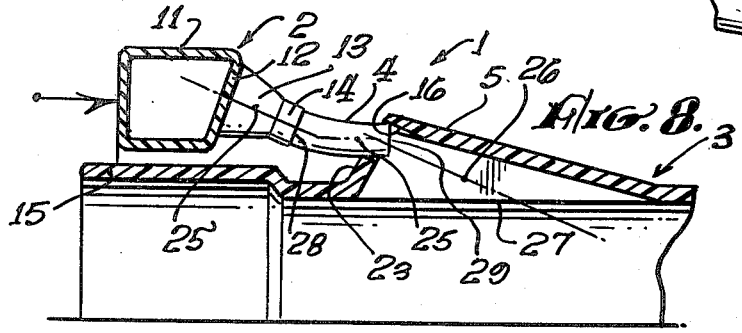

Referring now to FIG. 1 the assembled eductor, generally indicated as 1, is seen to be composed of two parts: a manifold ring, generally shown as 2 and a tube, generally shown as 3.

The manifold ring 2 is an integral subassembly, preferably a monolithic subassembly consisting of an annular ring main body 11, having a forward face 12, better seen in FIG. 3. Projecting forwardly and convergingly from face 12 are a plurality of from about two to about six, preferably four radially disposed jet nozzles 4, each mounted on a conical base 13 with an optional collar 14. The main body 11 is further provided with a size-stepped pressurized water inlet 6 adapted to receive water pressure hose 9 in any of several different sizes. The hose 9 is secured to inlet 6 by conventional hose clamp 24. One or two hose stubs are optionally provided of which stub 7 is rearwardly directed and stub 8 is forwardly directed. A relatively short length of hose, not shown, may be connected to stub 7 or 8 and is used to flush away fine sediments lodged in cavities or in interstices between large rocks to expose the underlying values for suction into the eductor.

The tube 3 is likewise an integral subassembly, preferably a monolithic subassembly, circular in cross-section and provided with a rearwardly directed bell end shown as 15. At a fixed distance forwardly of bell 15 and proximal thereto are provided a plurality of radially disposed bosses 5 equal in number to said plurality of nozzle jets 4. Each boss contains a forwardly converging porthole 16, better seen in FIGS. 2–14, adapted to snugly receive a corresponding nozzle jet 4 by forced coaxial translational movement of manifold ring 2 forwardly over tube 3.

An optional clamping means is shown in FIG. 2 consisting of bell-engaging articulated circular flange 17 containing six radially disposed threaded holes 18, rigid manifold ring-engaging circular flange 19 containing six radially disposed holes 20 adapted to align with the corresponding six threaded holes 18 and to slidably engage six screws 21 which are simultaneously threadably engaged in holes 18. A large number of variants of clamping means are possible. The embodiment illustrated in exploded view in FIG. 2 and as an assembly in FIG. 3 will serve for the purpose of this disclosure as representing a typical clamping means with fine adjustment capability, which is a desirable feature but not one to which this invention is to be restricted. The inside diameter of flange 17 is too small to pass over the bell 15 or over the bosses 5, hence the requirement that it be an articulated flange that can be opened up and wrapped around tube 3.

Figure 9:
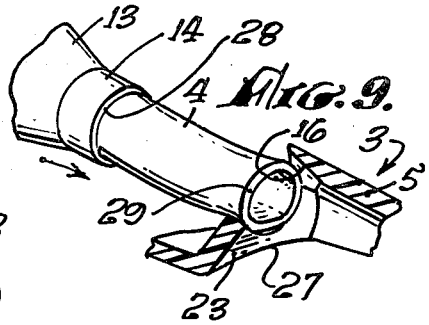

Spiral wound flexible suction hose 10 is shown in exploded view seen separated in FIG. 1 and connected to the eductor in FIG. 4, it being secured thereto by means of thread lugs 22 cast into the inside diameter of bell 15 as seen in FIGS. 1, 2 and 4. In FIG. 4 the jet nozzle 4 is shown in first point of contact with the abutment face 23 of boss 5. The centerline 25 of the jet nozzle 4 is not in registry with the centerline 26 of the porthole 16, requiring divergent flexure of nozzle 4 for it to enter porthole 16, better shown by comparing paired FIGS. 6 and 7 with paired FIGS. 8 and 9. In addition to the simple divergent flexure shown in FIG. 8 there is some flattening and ovalization of the jet nozzle tip as seen in FIG. 9.

Figure 10:
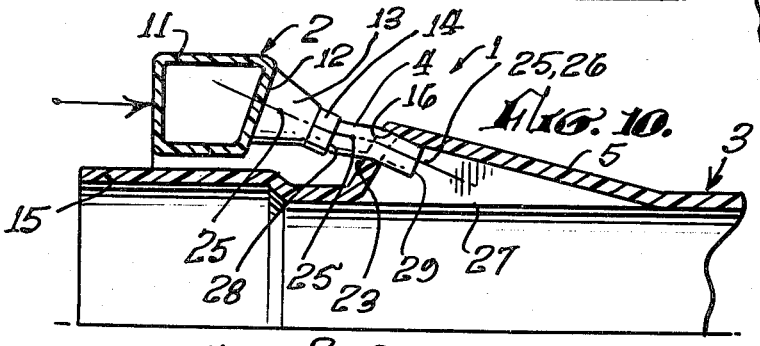
Figure 11:
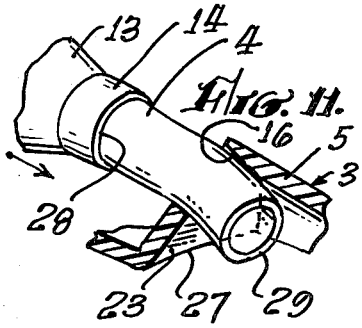

Paired FIGS. 10 and 11 show the jet nozzle distorted in divergent/convergent double flexure or S-curve when in the position of partial penetration short of home position. In the immediate vicinity of the porthole 16, which is the zone of maximum flexion, the nozzle may be undergoing kinking, plus, as shown better in FIG. 9, some flattening and ovalization.

Figure 12:
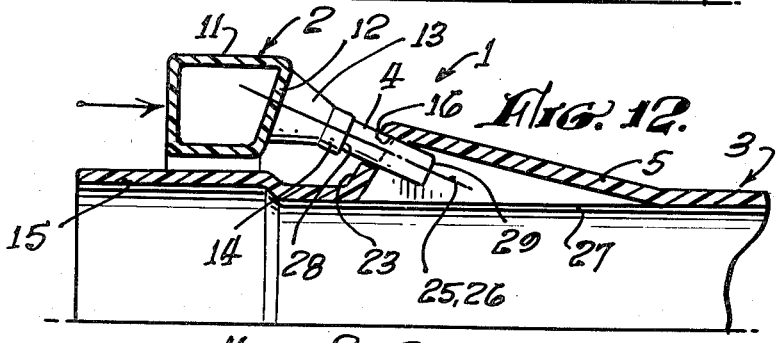
Figure 13:
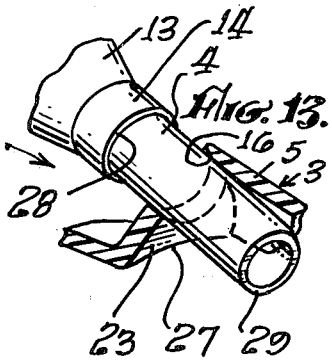

Paired FIGS. 12 and 13 show the configuration in home position, where the centerlines 25 and 26 are coaxial, congruent, and where the applied stresses have vanished, permitting the jet nozzle 4 to revert to its original as cast straight configuration.

Figure 14:
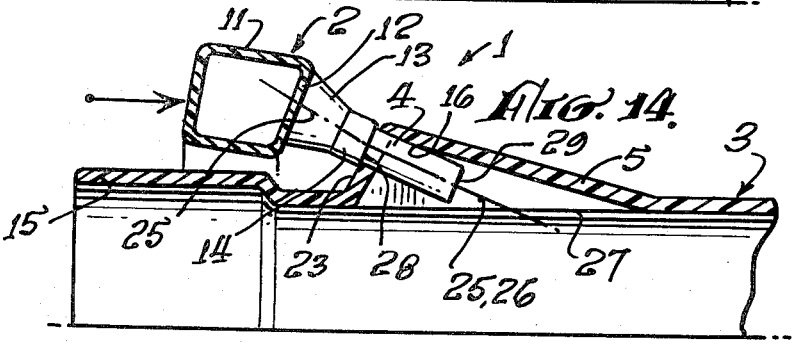

In FIG. 14 is depicted the condition where the penetration by the jet nozzle 4 has been advanced past the home position. The nozzle is now being flexed convergently, however, the tip of the nozzle has not quite entered the throat 27 of the nozzle.

It should be understood that the distortions of the nozzle as depicted in the Figures are deliberately exaggerated for the sake of illustration.

The property of viscoelasticity is found in most thermoplastic and thermoset polymers. These include polyethylenes, polypropylenes, polyesters, acrylics, methacrylics, nylons and polyvinyl chlorides, to list a few. Of these the preferred polymer is a cross-linkable high density polyethylene commercially known as MARLEX CL 50 or MARLEX CL 100. (MARLEX is a registered T.M. of Phillips Petroleum Company).

The two separate parts of the multiple jet eductor herein described can be mass produced cheaply and efficiently by the rotational molding process using, preferably MARLEX CL 50 or MARLEX CL 100 molding powder which contains a cross-linking additive. Coloring dye or pigment may be added at the point of charging into the mold. The advantage of MARLEX resides in the fact that prior to curing it is thermoplastic, but after curing at the molding temperature, 450°-650° F. (232°-343° C.), for the time specified by Phillips Petroleum Company, this polyethylene polymer cross-links and sets up into a semi-rigid polymer. The resulting thermoset polymer has excellent physical properties. It had a hard waxy feel with high lubricity and non-galling characteristics. It has a high molecular weight, melting point, density and crystalline/amorphous ratio. Chemically it consists mainly of long, unbranched polymethylene chains that terminate at one end in a vinyl group and at the other end in a methyl group. With a high degree of crystallinity resulting from this linear structure, MARLEX has greater stiffness and the following properties are outstanding:

| | English | Metric |
|---|---|---|
| Melt strength at | 400° F. | 205° C. |
| Impact strength at | −40° F. | −40° C. |
| Ultimate tensile strength | 2600 psi | 17.9 MPa |
| Elongation at break | 450% | 450% |
| Brittleness temperature | −180° F. | −118° C. |
| Flexural modulus | 100,000 psi | 689 MPa |

The rotationally molded manifold ring 2 and tube 3 are cast without jet orifices or portholes, respectively. These holes are subsequently drilled out to the precise angle of convergence that is selected from about 10° to about 45°, preferably 12° to 30°. The MARLEX is easily machined. If necessary, the jet orifices can be enlarged in the field with a hand drill or reamer.

The viscoelasticity of the nozzle can easily be demonstrated by clamping the manifold ring to a flat table top with the forward face 12 turned up. A horizontal force F directed radially outward is applied to one of the nozzle tips 29. Force F must be just sufficient to deflect the tip 29 a distance $D=L/8=0.125L$, where L is the length of the shank of the nozzle, i.e., as measured from the shoulder 28 to the tip 29. The force F should be held for 1 second and promptly relaxed. The tip 29 will then revert to its original as cast straight configuration in due course of time, 24 hours. An arbitrary stipulation of 24 hours waiting period allows ample time for this recovery. The size of an eductor is commercially designated by the diameter of the throat 27. Typically the length L is approximately equal to one-half of the diameter of the throat 27 of the tube 3. The overall length of tube 3=about 6 throat diameters. The axial distance from the bell end to the porthole 16=about 1 throat diameter. The axial length of the bell end=about 0.8 throat diameter. These ratios are illustrative for the purpose of this disclosure, but are not critical and the invention is not restricted thereto.

I claim:

1. In a two part multiple jet pump of which a first part consists essentially of a manifold ring which is provided with a pressurized water inlet and a first plurality of radially spaced, forwardly, and convergingly, directed jet nozzles, a second part consists essentially of a tube having a bell end, said second part being provided, proximally to and at a fixed axial distance from the bell end, with a second plurality of radially disposed bosses equal in number to said first plurality, each boss containing a forwardly, and convergingly, directed porthole adapted to snugly receive a corresponding one of said jet nozzles wherein high pressure water passes through said jet nozzles and into said tube whereat said high pressure water entrains a pumped fluid and develops a low pressure, the improvement consisting of assembling the jet pump by forced simple coaxial translation motion of said first part over said bell end of said second part, all of said jet nozzles simultaneously engaging and entering corresponding ones of said portholes with transitory snake-like flexure in an intermediate position and finally penetrating to a "home position" whereat said jet nozzles revert to their original, free of stress or distortion, molded, straight configuration, and securing said first part to said second part proximally in said "home position" by suitable means.

2. The jet pump according to claim 1 wherein the number of said first plurality is four.

3. The jet pump according to claim 1 wherein the material of construction is a viscoelastic polymer.

4. The jet pump according to claim 3 wherein the viscoelastic polymer is a thermoplastic polymer.

5. The jet pump according to claim 3 wherein the viscoelastic polymer is a thermoset polymer.

6. The jet pump according to claim 3 wherein the viscoelastic polymer is selected from the group consisting of polyethylene, polypropylene, nylon, polyester and polyvinyl chloride.

7. The jet pump according to claim 6 wherein the viscoelastic polymer is cross-linked polyethylene.

8. The jet pump according to claim 7 wherein the cross-linked polyethylene is one selected from the group consisting of MARLEX CL 50 and MARLEX CL 100 manufactured by Phillips Petroleum Company.

9. The jet pump according to claim 1 wherein said first and second parts are monolithic parts.

10. The jet pump according to claim 9 wherein any one of said jet nozzles is viscoelastic to the extent that, after having been stressed in cantileverflexion for 1 second to a displacement distance as measured at the tip of said jet nozzle equal to the shank length of said jet nozzle times 0.125, said jet nozzle will spontaneously revert upon relief of said stress to its original straight, molded configuration within 24 hours.

11. The jet pump according to claim 10 wherein said manifold ring is provided with one or more optional hose stubs.

12. The jet pump according to claim 11 wherein the pressure water inlet to said manifold ring is stepped to receive hoses of different diameters.

13. The jet pump according to claim 12 wherein the inside diameter of said bell end is provided with thread lugs to threadably engage a spiral wound suction hose.

14. The jet pump according to claim 13 wherein means is provided for fine adjustment of the performance by limited translational advancement or retraction of the jet nozzles in the portholes from "home position" to alter their angle of convergence and securing thereat.

* * * * *